US006960093B1

(12) United States Patent
Fan

(10) Patent No.: US 6,960,093 B1
(45) Date of Patent: Nov. 1, 2005

(54) INTERFACE CARD CONNECTOR

(75) Inventor: Shih-Ching Fan, Taipei (TW)

(73) Assignee: Egdon Electronics Ltd., Taipei (TW)

( * ) Notice: Subject to any disclaimer, the term of this patent is extended or adjusted under 35 U.S.C. 154(b) by 0 days.

(21) Appl. No.: 10/834,841

(22) Filed: Apr. 30, 2004

(51) Int. Cl.[7] ..... H01R 13/62
(52) U.S. Cl. ..... 439/326; 439/62; 439/153
(58) Field of Search ..... 439/62, 153–157, 439/326–327

(56) References Cited

U.S. PATENT DOCUMENTS

| | | | | |
|---|---|---|---|---|
| 5,209,675 | A * | 5/1993 | Korsunsky | 439/326 |
| 5,244,403 | A * | 9/1993 | Smith et al. | 439/326 |
| 5,374,203 | A * | 12/1994 | Sato et al. | 439/326 |
| 5,730,614 | A * | 3/1998 | Yu | 439/326 |
| 6,672,888 | B1 * | 1/2004 | Ku | 439/153 |
| 6,743,028 | B2 * | 6/2004 | Wang | 439/92 |

* cited by examiner

*Primary Examiner*—Michael C. Zarroli
(74) *Attorney, Agent, or Firm*—Dennison, Schultz, Dougherty & MacDonald

(57) ABSTRACT

An interface card connector having a slotted seat and a locking mechanism having an end for connecting with the slotted seat. The locking mechanism is provided on the top thereof with a hook with an inclined surface, in order to guide an interface card downwardly for engaging into a "U" shaped notch provided on the lower portion of one side of the interface card, thereby the interface card is fixedly connected with the slotted seat; the locking mechanism is provided on the bottom thereof with an abutting portion extending upwardly to an angular direction, so that when the moving and holding portion of the locking mechanism is moved, the abutting portion pushes the interface card upwardly to release it from the slotted seat easily. The connector is suitable for use as an interface card connector to connect an electrically connecting interface card with a printed circuit board of a mainframe of a computer.

9 Claims, 11 Drawing Sheets

INTERFACE CARD CONNECTOR

BACKGROUND OF THE INVENTION

1. Field of the Invention

The present invention is related to an interface card connector, and especially to a structure that is provided on an end of a slotted seat thereof with a locking means for direct insertion of the interface card in the slotted seat, and after the locking means is moved, one side of the interface card can be moved upwardly, this can assure the interface card to be firmly positioned in the slotted seat, and can be removed easily; the interface card connector is suitable for use as one for connecting an electrically connecting interface card with a printed circuit board of a mainframe of a computer.

2. Description of the Prior Art

Normally there are several slotted seats provided in a mainframe of a computer presently for inserting connection of interface cards by a user, hence amount of external equipments can be increased, and new functions can be added. As shown in FIG. 11, a conventional interface card "a" is directly inserted in an insertion slot "c" of a slotted seat "b", so that a printed circuit board "d" beneath the slotted seat "b" can be electrically connected. By the fact that the gap between every of neighboring contact pins "e" of the interface card "a" is very small, when the interface card "a" is contacted with contact pieces "f" in the insertion slot "c", only very little error because of deviation is probable. However, inevitably there are vibrations of different amplitudes during using of the computer or during the process of moving and assembling, such vibrations often make the interface card "a" unable to normally operate because of loosening or deviation for those having the interface card "a" and the slotted seat "b" with smaller tolerances.

When the above stated interface card "a" and slotted seat "b" are connected with each other, once they form a firm connection, the interface card "a" will be quite hard to be drawn out for changing; and often the mainframe of the computer is full of various components, if the interface card "a" is unduly extracted by a force, an operator or the components of the computer are subjected to damaging.

In view of these, the inventor provides the present invention based on his professional experience of years and after hard study and continue improvement to solve the above stated defects in order to make an interface card able to be firmly positioned and easily removed.

SUMMARY OF THE INVENTION

The main object of the present invention is to provide an interface card connector that guides an interface card downwardly by pressing the interface card against a locking means provided thereunder and an inclined surface of a hook above the locking means, so that the hook is engaged in a "U" shaped notch of the interface card, and so that the interface card can be assured to completely insert into and to be firmly positioned in an insertion slot of a slotted seat.

The secondary object of the present invention is to provide an interface card connector that is abutted on the bottom of one side of the interface card by means of an abutting structure provided below the locking means; when the locking means is triggered, the abutting structure can be moved horizontally, and by means of the inclined surface, one side of the interface card moves upwardly, so that the interface card can be easily removed from the slotted seat.

To get the above objects of the present invention, the interface card connector provided by the present invention comprises a slotted seat and a locking means. The slotted seat is connected to the top of a printed circuit board for insertion connecting and fixing of the interface card thereon; the locking means has an elastic portion of which one end is provided with a connecting portion for connecting with the slotted seat, while the other end is provided with a moving and holding portion. The elastic portion is provided on the top thereof with a hook with an inclined surface, in order to guide an interface card downwardly; and the elastic portion is provided on the bottom thereof with an abutting portion extending upwardly to an angular direction to abut on the bottom of one side of the interface card.

Thereby, the hook of the locking means can be engaged into the "U" shaped notch provided on the lower portion of one side of the interface card, thereby the interface card can be fixedly connected with the slotted seat; when the moving and holding portion of the locking means is moved, the abutting portion can push the interface card upwardly to make the latter released from the slotted seat.

The present invention will be apparent after reading the detailed description of the preferred embodiment thereof in reference to the accompanying drawings.

DETAILED DESCRIPTION OF THE PREFERRED EMBODIMENT

Figure 1:
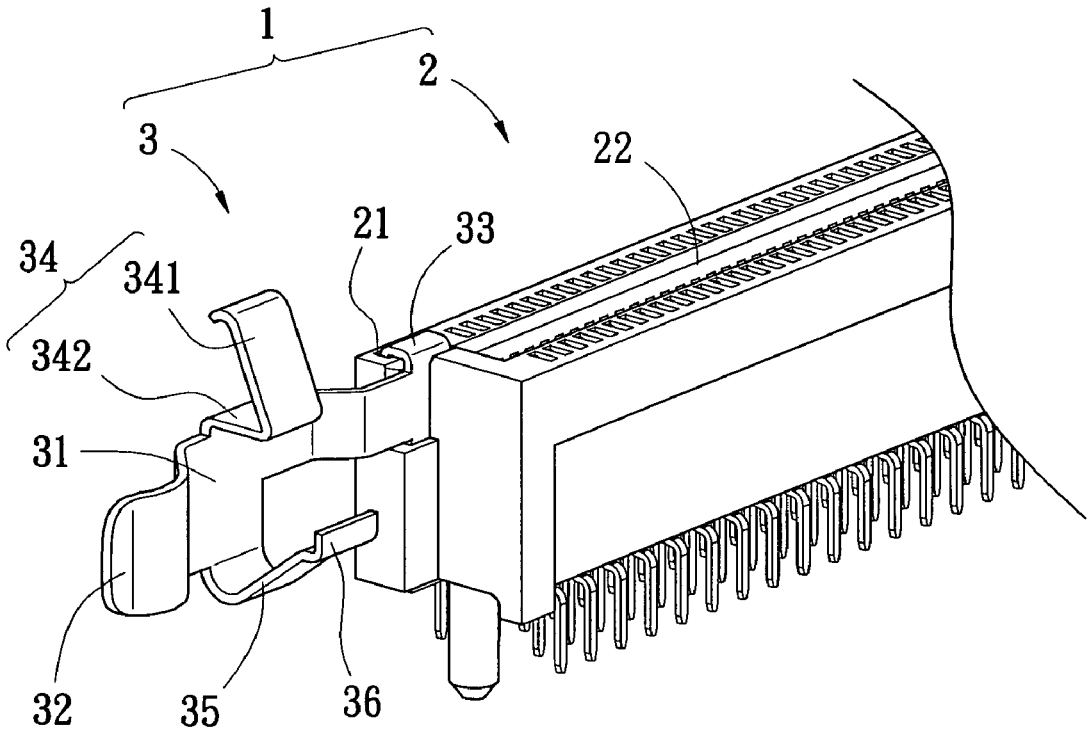
FIG. 1 is a perspective view showing the appearance of a first embodiment of the present invention.
Figure 2:
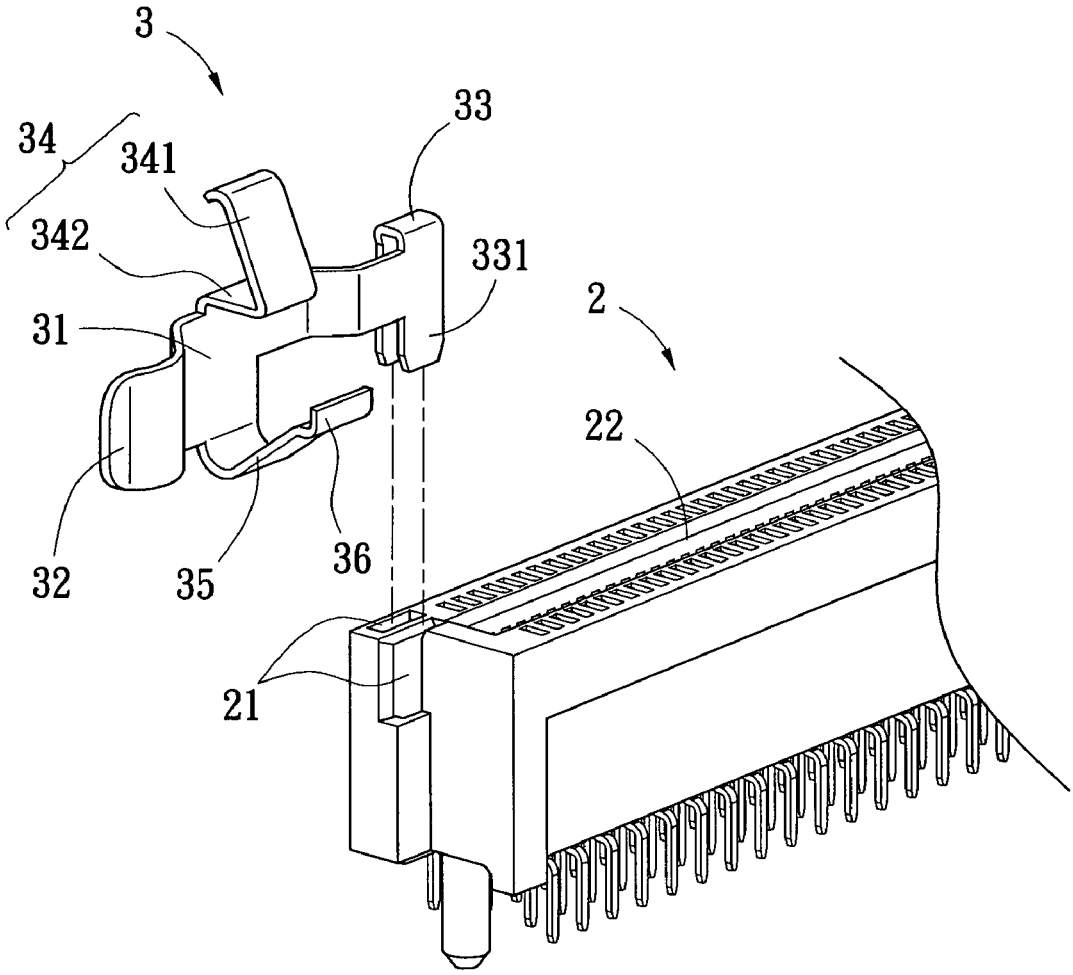
FIG. 2 is an analytic perspective view of the first embodiment of the present invention.
Figure 3:
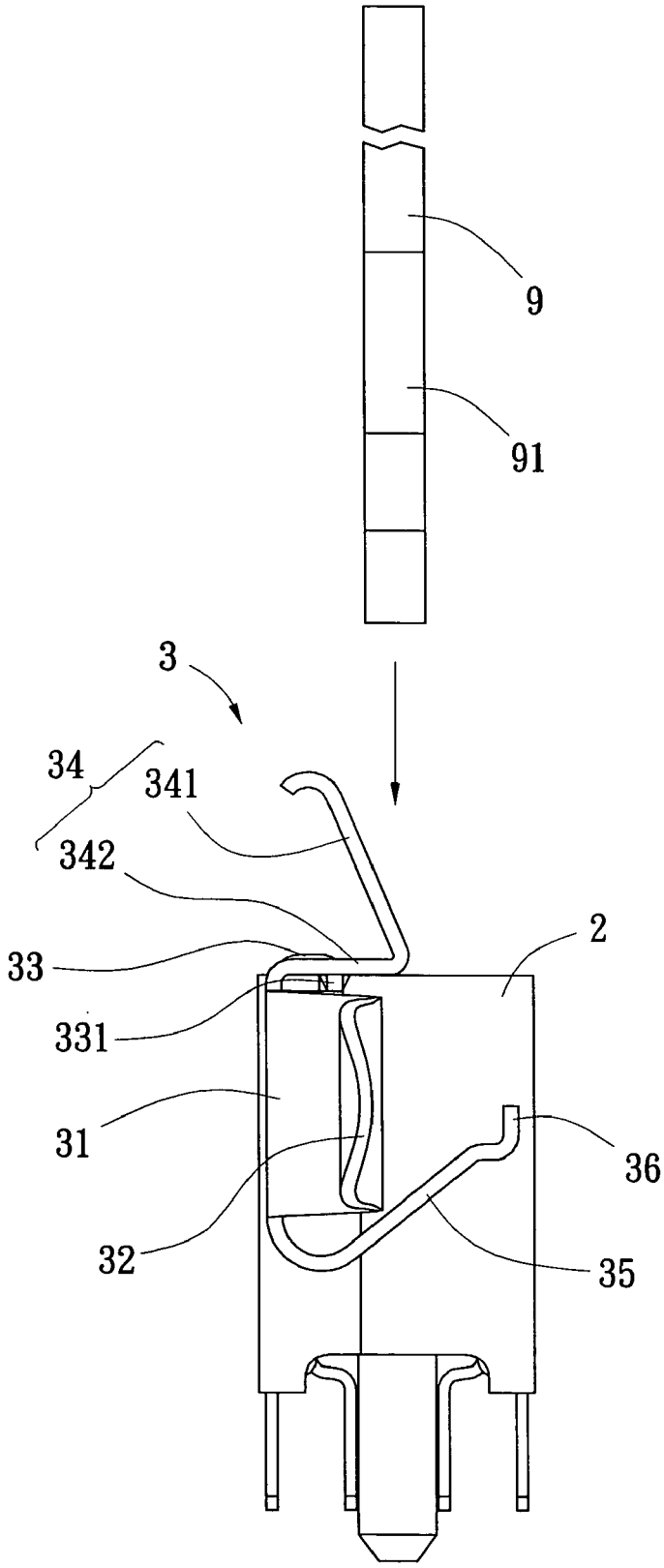
FIG. 3 is a side view showing the state before insertion of the first embodiment of the present invention into an interface card.
Figure 4:
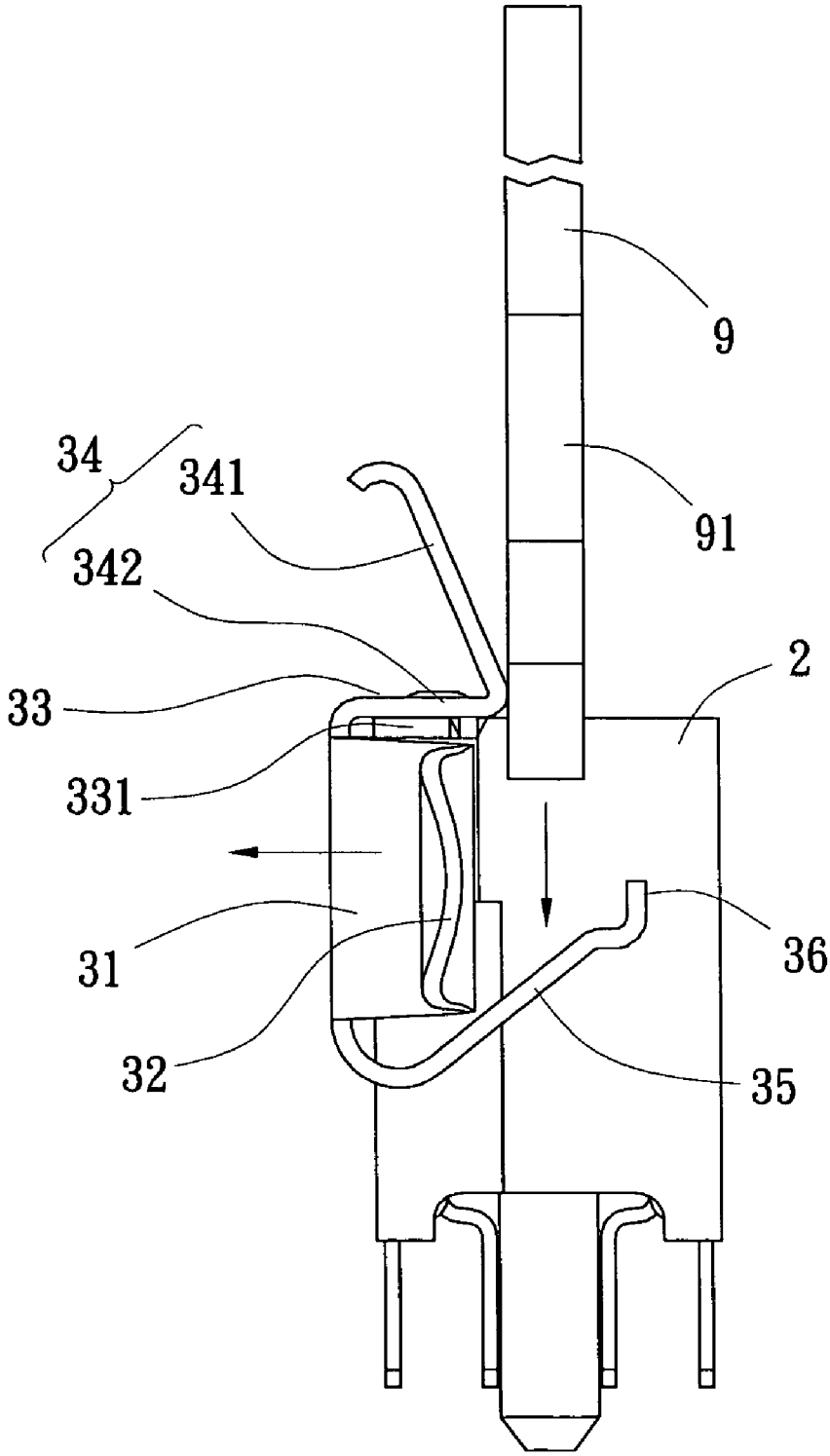
FIG. 4 is a side view showing insertion of the first embodiment of the present invention into an interface card.
Figure 5:
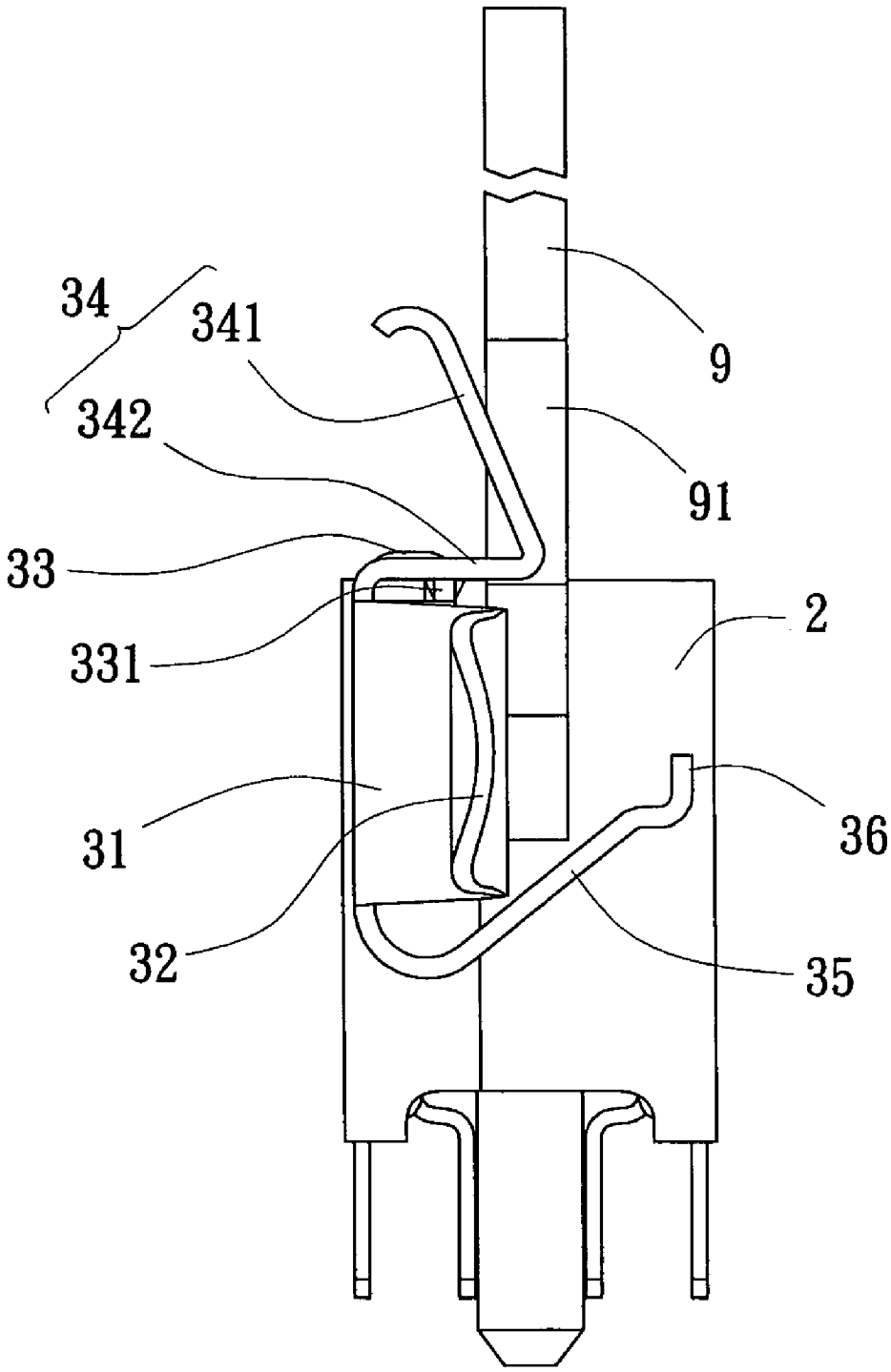
FIG. 5 is a side view showing the state after insertion of the first embodiment of the present invention into an interface card.

Referring to FIGS. 1 and 2 showing a first embodiment of an interface card connector 1 of the present invention, the connector 1 comprises a slotted seat 2 and a locking means 3.

Figure 6:
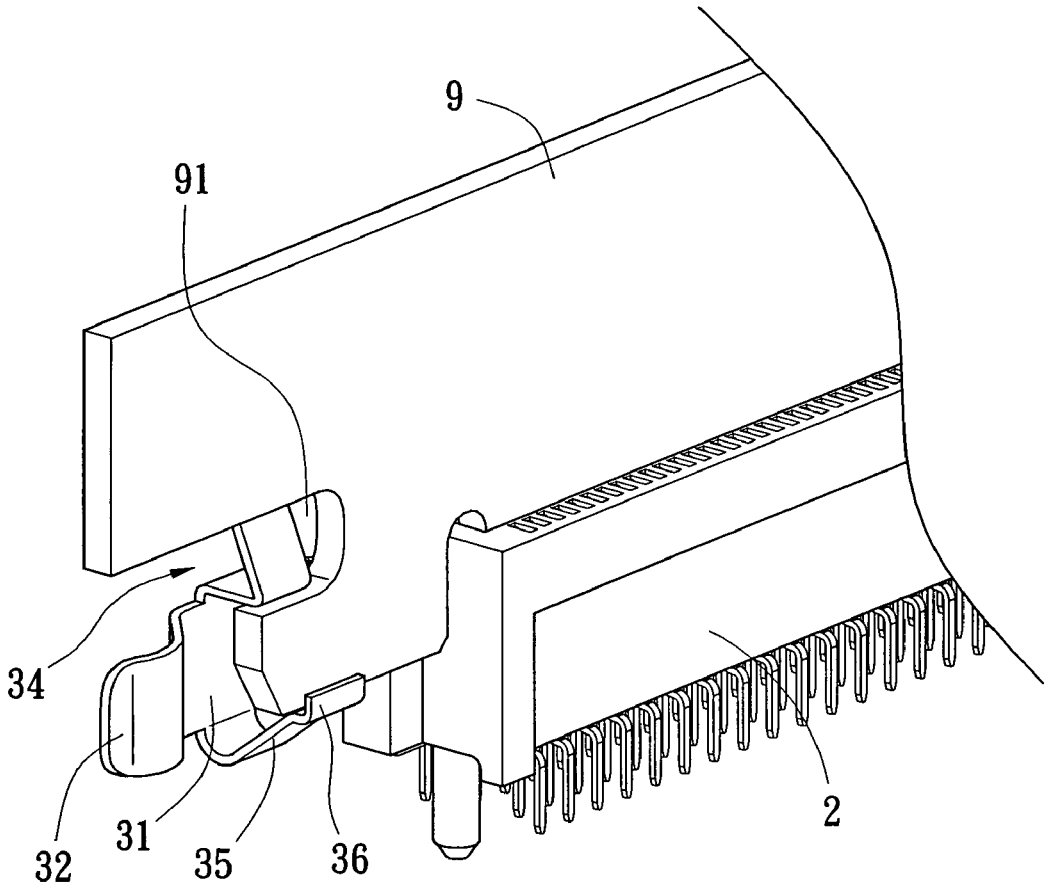
FIG. 6 is a perspective view showing the appearance after the first embodiment of the present invention is assembled with the interface card.

The slotted seat 2 is connected onto a printed circuit board (not shown), and has an insertion slot 22 for inserting and fixing of an interface card 9 (as shown in FIG. 6), the slotted seat 2 is provided thereon with two rectangular recesses 21.

The locking means 3 is shaped by bending from a metallic sheet, it has an elastic portion 31; one end of the elastic portion 31 is extended to form a moving and holding portion 32, and the other end thereof has a connecting portion 33, the connecting portion 33 is in the shape of an inversed "U" and has two downwardly extending elongate feet 331 for inserting and fixing into the two rectangular recesses 21 of the slotted seat 2, in order that the locking means 3 can be tightly combined with the slotted seat 2. The elastic portion 31 has a hook 34 which includes an inclined surface 341 and a transverse portion 342; one end of the transverse portion 342 is formed by bending to the horizontal direction from the top of the elastic portion 31, and is provided to be orthogonal to the elastic portion 31, while the inclined surface 341 is formed by bending upwardly for an angle from the other end of the transverse portion 342. The elastic portion 31 is provided on the bottom thereof with an abutting portion 35 extending upwardly to an angular direction to abut on the bottom of one side of the interface card 9; and a tailing end of the abutting portion 35 is extended to form an upright portion 36.

Referring to FIGS. 3–6, when the interface card 9 is inserted for connecting from above the slotted seat 2, the bottom of the interface card 9 abuts against the inclined surface 341 of the hook 34 of the locking means 3, so that the locking means 3 is horizontally moved outwardly, while the inclined surface 341 synchronically guides the interface card 9 downwardly; then the interface card 9 is completely inserted into the insertion slot 22 of the slotted seat 2, the locking means 3 can have its hook 34 engaged into a "U" shaped notch 91 provided on the lower portion of one side of the interface card 9 by a resilient force generated by bending the locking means 3, and the transverse portion 342 of the hook 34 is engaged on the bottom of the "U" shaped notch 91, thereby the interface card 9 interface card 9 can be completely fixedly connected with the slotted seat 2.

Figure 7:
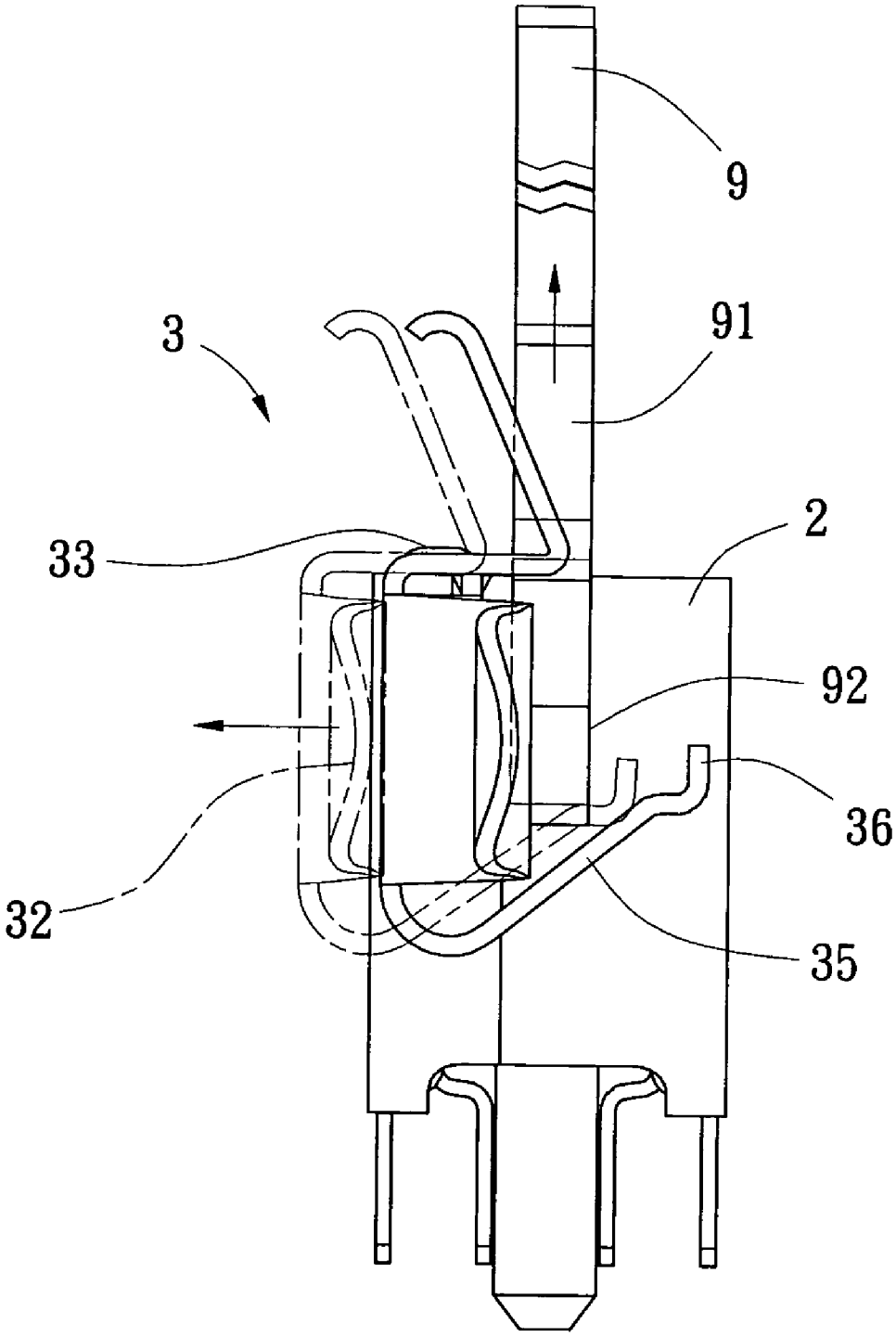
FIG. 7 is a schematic view showing a state of use wherein the first embodiment of the present invention pushes the interface card.

Referring to FIG. 7, when the moving and holding portion 32 of the locking means 3 is moved, the abutting portion 35 on the bottom of the locking means 3 is moved to displace horizontally, and can push one side of the interface card 9 upwardly to make the latter released from the slotted seat 2 easily. When the locking means 3 is moved to bend toward one side taking the connecting portion 33 as a fulcrum, the upright portion 36 at the tailing end of the abutting portion 35 is abutted against a side 92 of the interface card 9 to render the locking means 3 unable to keep on moving, this can prevent the locking means 3 from breakage by overly bending.

Figure 8:
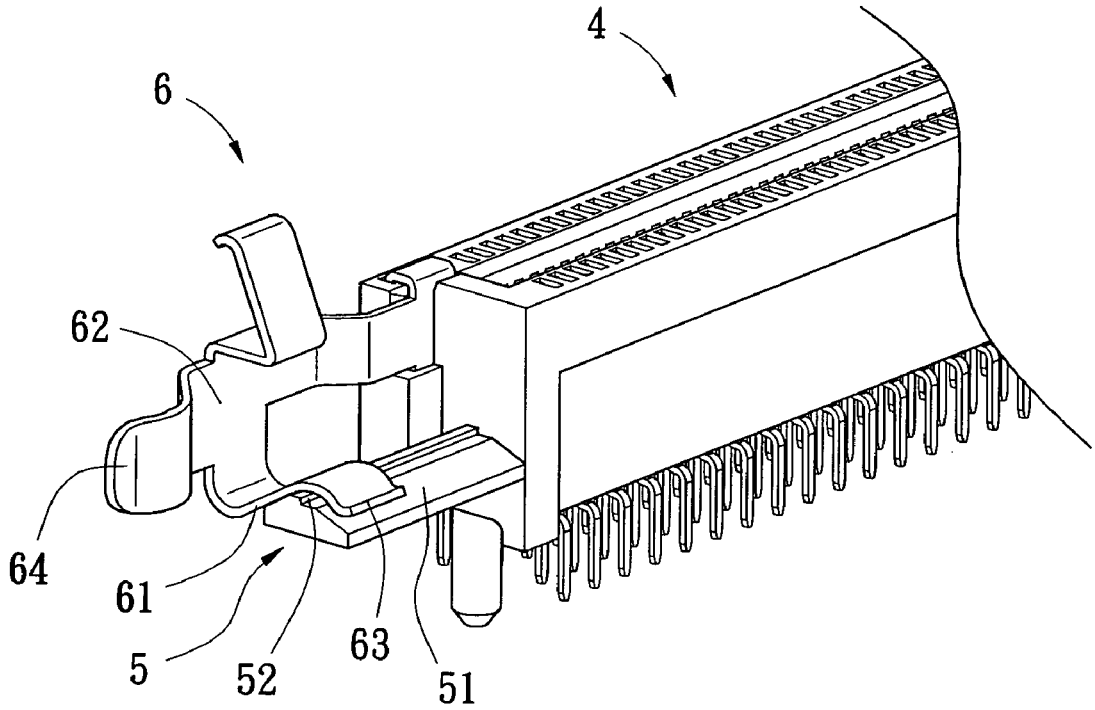
FIG. 8 is a perspective view showing the appearance of a second embodiment of the present invention.
Figure 9:
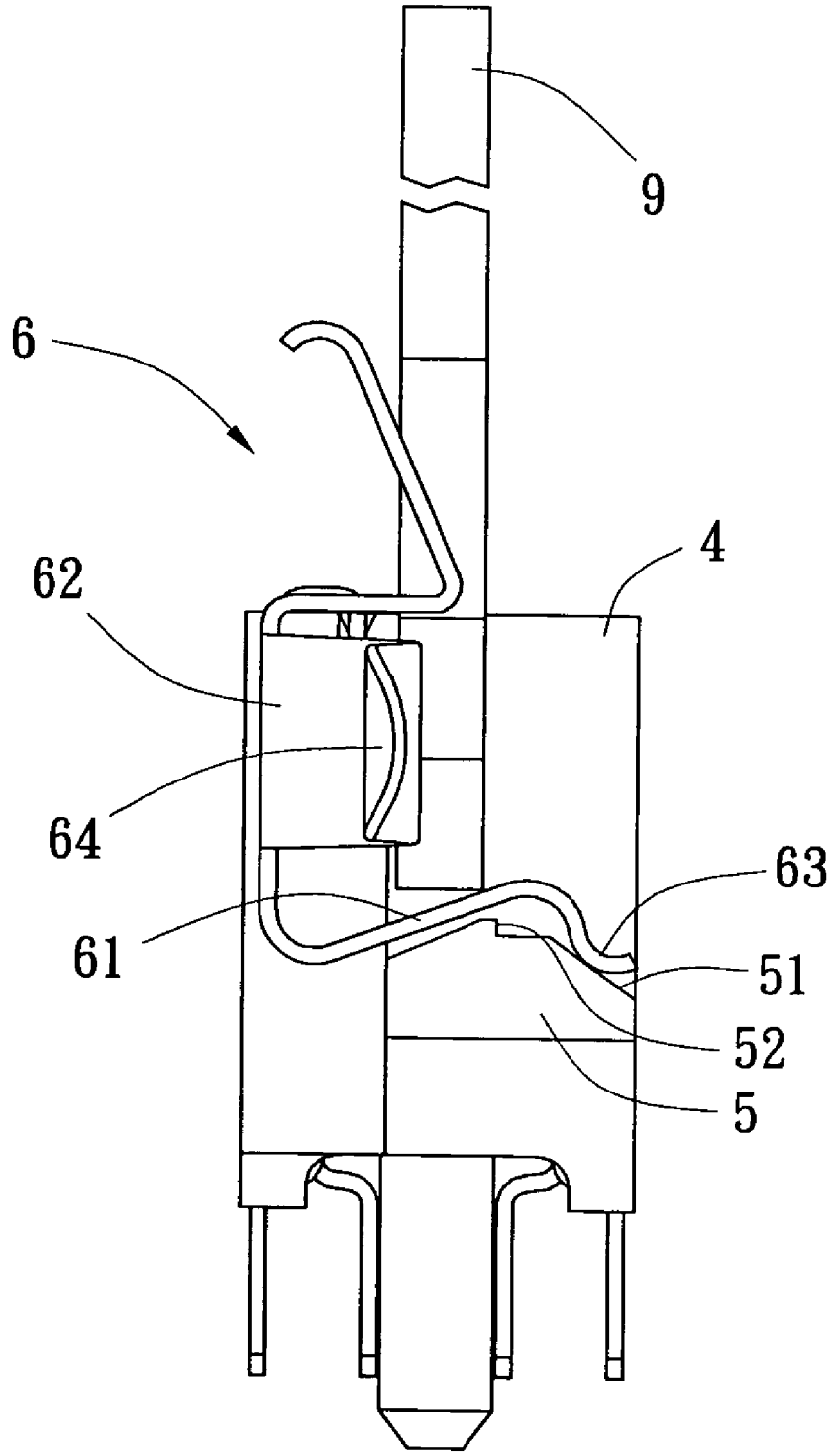
FIG. 9 is a side view showing the state after insertion of the second embodiment of the present invention into an interface card.

Referring to FIGS. 8 and 9 which show a second embodiment of the present invention, wherein an slotted seat 4 is provided on one end thereof with a supporting piece 5 extending horizontally; the supporting piece 5 is provided on the top near to one side thereof with an inclined surface 51, and is provided in the middle thereof with a vertical error-proof surface 52; an abutting portion 61 of a locking means 6 is extended upwardly to an angular direction from an elastic portion 62, and is provided on the tailing end thereof with a downwardly extending contact sheet portion 63 in the form of a scoop.

Figure 10:
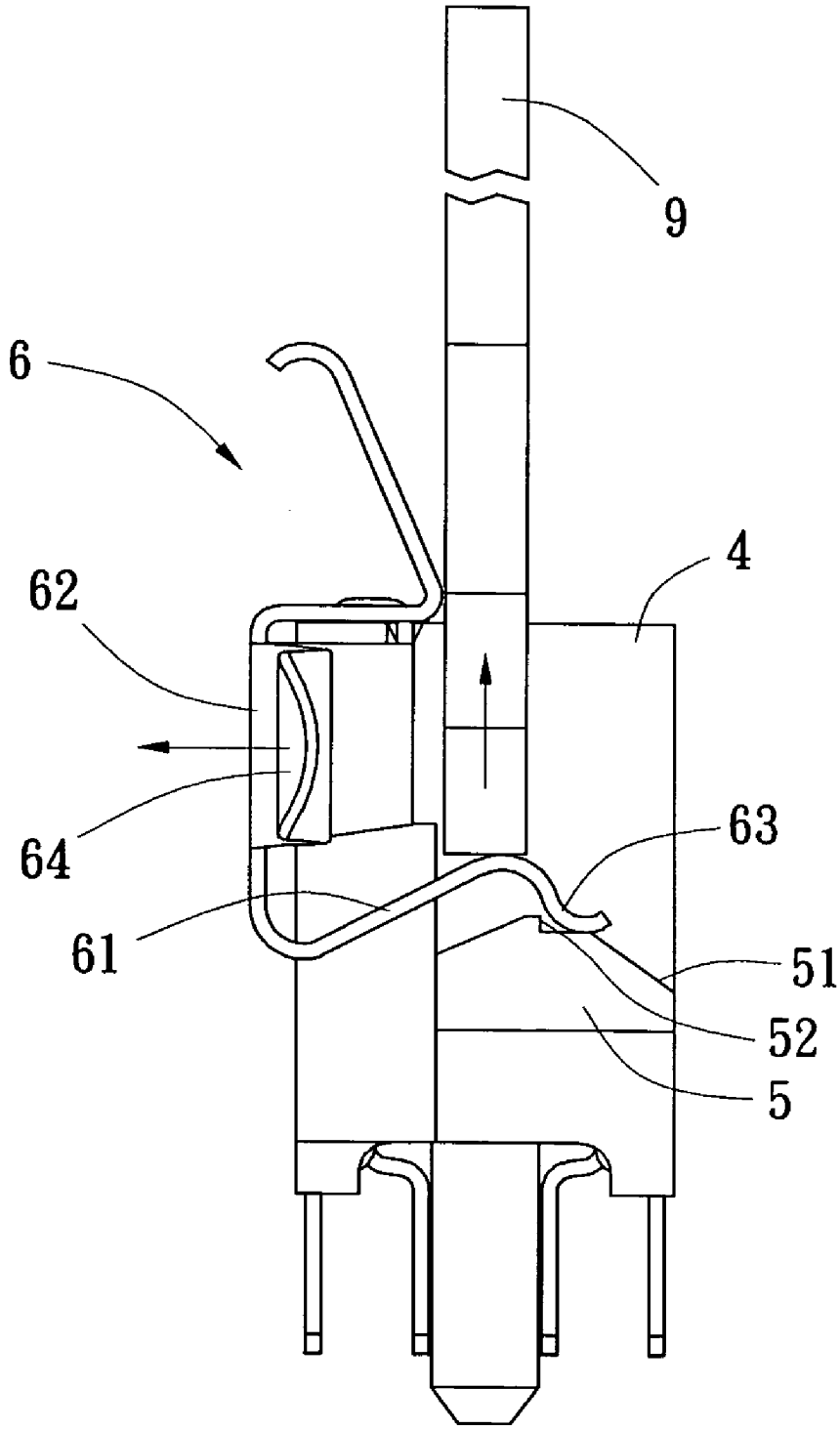
FIG. 10 is a schematic view showing a state of use wherein the second embodiment of the present invention pushes the interface card.
Figure 11:
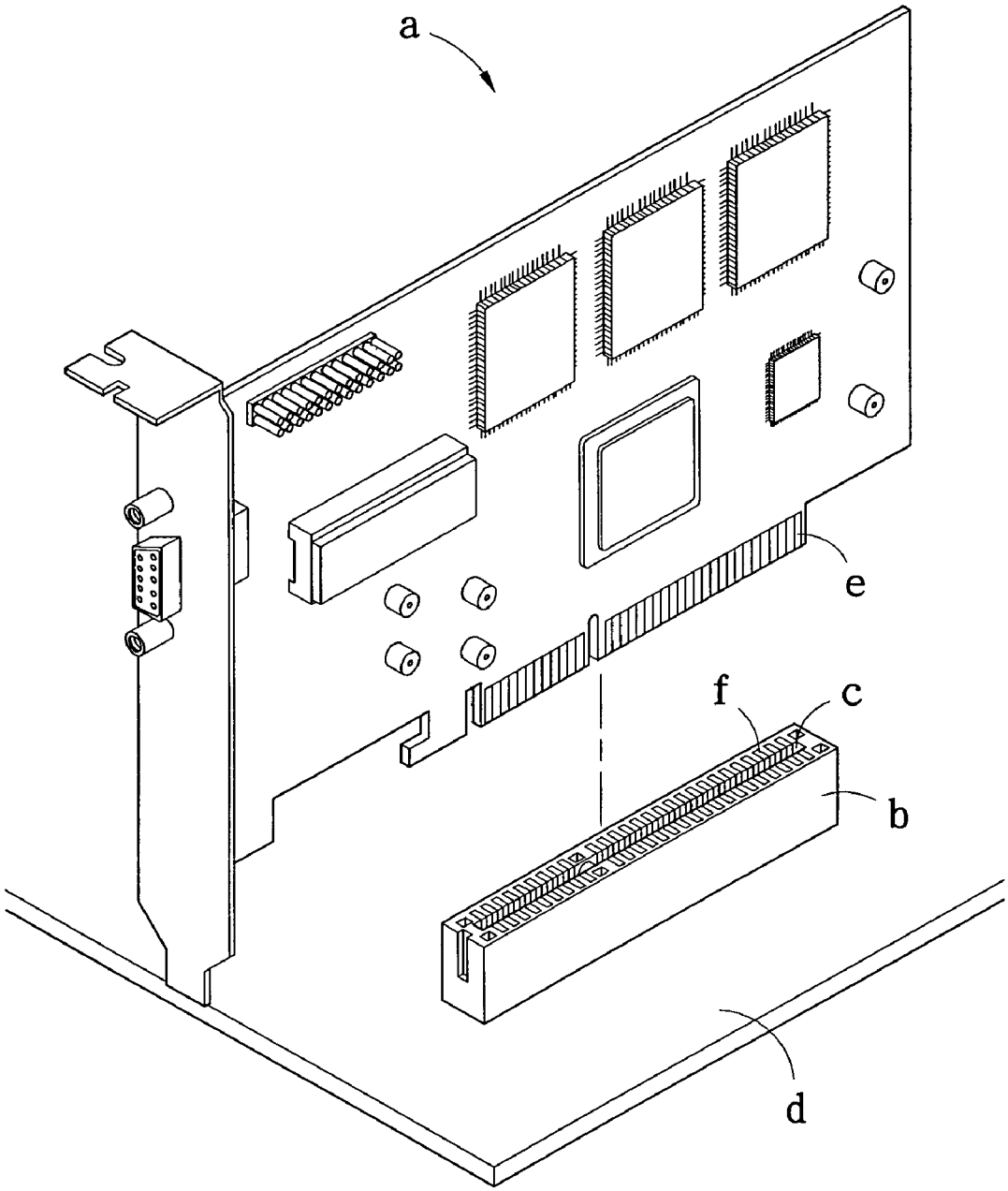
Fig. 11(PRIOR ART)
FIG. 11 is a perspective view showing the appearance of a conventional slotted seat being separated from an interface card.

And referring to FIG. 10, when a moving and holding portion 64 of the locking means 6 is moved, the contact sheet portion 63 on the tailing end of the abutting portion 61 slides upwardly along the inclined surface 51 on the top near to one side of the supporting piece 5, so that the abutting portion 61 pushes the interface card 9 upwardly; when the contact sheet portion 63 abuts against the error-proof surface 52 in the middle of the supporting piece 5, it can effectively prevent overly bending of the locking means 6.

Therefore, the present invention has the following advantages:

1. The locking means provided in the present invention has elasticity, the hook provided thereon has an inclined surface, when the interface card is inserted downwardly for connecting, the locking means is forced to displace horizontally, the interface card is directly inserted in the insertion slot of the slotted seat to make engagement of the hook in the "U" shaped notch of the interface card. This can assure good electric connection of the interface card with the electric circuit board and firmness of connection.

2. The locking means provided in the present invention is provided on the bottom thereof with an abutting portion extending upwardly to an angular direction to abut on the bottom of one side of the interface card. When the moving and holding portion of the locking means is moved, the abutting portion is moved to displace horizontally, and can push one side of the interface card upwardly taking advantage of the inclined surface to make the latter released from the slotted seat easily.

3. The locking means provided in the first embodiment of the present invention can be moved to bend toward one side taking the connecting portion as a fulcrum, the upright portion at the tailing end of the abutting portion is abutted against a side of the interface card to render the locking means unable to keep on moving, this can prevent the locking means from breakage by overly bending. And in the second embodiment of the present invention, the contact sheet portion of the locking means abuts against the error-proof surface in the middle of the supporting piece; this can also has the advantage of effectively preventing overly bending of the locking means.

In conclusion, according to the description disclosed above, the present invention surely can get the expected object thereof to provide an interface card connector able to make an interface card be firmly positioned in an insertion slot of a slotted seat, and make the interface card able to be removed easily from the slotted seat; thereby the present invention is extremely industrially valuable. Having thus described my invention, what we claim will be declared in the claims followed.

What is claimed is:

1. An interface card connector comprising:

a slotted seat connected to the top of a printed circuit board for insertion connecting and fixing of an interface card thereon; and a locking means, having an elastic portion of which one end is provided with a connecting portion for connecting with said slotted seat, while the other end is provided with a moving and holding portion; said elastic portion is provided on the top thereof with a hook with an inclined surface, in order to guide an interface card downwardly; and said elastic portion is provided on the bottom thereof with an abutting portion extending upwardly to an angular direction to abut on the bottom of one side of said interface card;

thereby, said hook of said locking means is adapted for engaging into a "U" shaped notch provided on said lower portion of one side of said interface card, thereby said interface card is fixedly connected with said slotted seat;—when said moving and holding portion of said locking means is moved, said abutting portion pushes said interface card upwardly to release it from said slotted seat, wherein said slotted seat is provided on one end thereof with a supporting piece extending horizontally; said supporting piece is provided on the top near to one side thereof with an inclined surface, and is provided in the middle thereof with a vertical error-proof surface; said abutting portion is extended upwardly to an angular direction from said elastic portion, and is provided on the tailing end thereof with a downwardly extending contact sheet portion in the form of a scoop; when said moving and holding portion on one end of said locking means is moved, said contact sheet portion slides upwardly along said inclined surface on said top near to said one side of said supporting piece, so that said abutting portion pushes said interface card upwardly; when said contact sheet portion abuts against said error-proof surface in said middle of said supporting piece, it effectively prevents overly bending of said locking means.

2. The interface card connector as in claim 1, wherein said locking means is shaped by bending from a metallic sheet.

3. The interface card connector as in claim 1, wherein said slotted seat is provided thereon with two rectangular recesses; said connecting portion of said locking means is in the shape of an inversed "U" and has two downwardly extending elongate feet for inserting and fixing into said two rectangular recesses of said slotted seat.

4. The interface card connector as in claim 1, wherein said hook of said locking means includes an inclined surface bent for an angle and a transverse portion; said transverse portion is bent to the horizontal direction from the top of said elastic portion, and is provided to be orthogonal to said elastic portion.

5. The interface card connector as in claim 1, wherein said abutting portion of said locking means is extended upwardly to an angular direction from said elastic portion, and is provided on the tailing end thereof with an upright portion.

6. An interface card connector comprising:

a slotted seat connected to the top of a printed circuit board for insertion connecting and fixing of an interface card thereon; and a locking means, having an elastic portion of which one end is provided with a connecting portion for connecting with said slotted seat, while the other end is provided with a moving and holding portion; said elastic portion is provided on the top thereof with a hook with an inclined surface, in order to guide an interface card downwardly; and said elastic portion is provided on the bottom thereof with an abutting portion extending upwardly to an angular direction to abut on the bottom of one side of said interface card;

thereby, said hook of said locking means is adapted for engaging into a "U" shaped notch provided on said lower portion of one side of said interface card, thereby said interface card is fixedly connected with said slotted seat;—when said moving and holding portion of said locking means is moved, said abutting portion pushes said interface card upwardly to release it from said slotted seat, and wherein said abutting portion of said locking means is extended upwardly to an angular direction from said elastic portion, and is provided on the tailing end thereof with an upright portion, and wherein said slotted seat is provided on one end thereof with a supporting piece extending horizontally; said supporting piece is provided on the top near to one side thereof with an inclined surface, and is provided in the middle thereof with a vertical error-proof surface; said abutting portion is extended upwardly to an angular direction from said elastic portion, and is provided on the tailing end thereof with a downwardly extending contact sheet portion in the form of a scoop: when said moving and holding portion on one end of said locking means is moved, said contact sheet portion slides upwardly along said inclined surface on said top near to said one side of said supporting piece, so that said abutting portion pushes said interface card upwardly; when said contact sheet portion abuts against said error-proof surface in said middle of said supporting piece, it effectively prevents overly bending of said locking means.

7. The interface card connector as in claim 6, wherein said locking means is shaped by bending from a metallic sheet.

8. The interface card connector as in claim 6, wherein said slotted seat is provided thereon with two rectangular recesses; said connecting portion of said locking means is in the shape of an inversed "U" and has two downwardly extending elongate feet for inserting and fixing into said two rectangular recesses of said slotted seat.

9. The interface card connector as in claim 6, wherein said hook of said locking means includes an inclined surface bent for an angle and a transverse portion; said transverse portion is bent to the horizontal direction from the top of said elastic portion, and is provided to be orthogonal to said elastic portion.

* * * * *

UNITED STATES PATENT AND TRADEMARK OFFICE

CERTIFICATE OF CORRECTION

PATENT NO. : 6,960,093 B1
DATED : November 1, 2005
INVENTOR(S) : Shih-Ching Fan

It is certified that error appears in the above-identified patent and that said Letters Patent is hereby corrected as shown below:

Title page,
Item [73], Assignee, "Egdon Electronics Ltd." each occurrence, should read
-- Egbon Electronics Ltd. --.

Signed and Sealed this

Sixth Day of June, 2006

JON W. DUDAS
*Director of the United States Patent and Trademark Office*